US012716200B2

(12) United States Patent
Nakajima et al.

(10) Patent No.: US 12,716,200 B2
(45) Date of Patent: Aug. 25, 2026

(54) HYDRAULIC CONTROL SYSTEM AND SETTING METHOD AND CALIBRATION METHOD OF TARGET ENGINE TORQUE DURING RELIEF IN HYDRAULIC CONTROL SYSTEM

(71) Applicant: Caterpillar SARL, Geneva (CH)

(72) Inventors: Hideki Nakajima, Akashi (JP); Toshikazu Koga, Akashi (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 18/681,996

(22) PCT Filed: Aug. 19, 2022

(86) PCT No.: PCT/EP2022/025383
§ 371 (c)(1),
(2) Date: Feb. 7, 2024

(87) PCT Pub. No.: WO2023/025412
PCT Pub. Date: Mar. 2, 2023

(65) Prior Publication Data

US 2025/0003194 A1 Jan. 2, 2025

(30) Foreign Application Priority Data

Aug. 26, 2021 (JP) ..... 2021-137855

(51) Int. Cl.
*E02F 9/22* (2006.01)
*E02F 9/26* (2006.01)

(52) U.S. Cl.
CPC ..... *E02F 9/2235* (2013.01); *E02F 9/2246* (2013.01); *E02F 9/2296* (2013.01); *E02F 9/267* (2013.01)

(58) Field of Classification Search
CPC ..... E02F 9/2235; E02F 9/2246; E02F 9/2296; E02F 9/267
(Continued)

(56) References Cited

U.S. PATENT DOCUMENTS

2010/0170239 A1* 7/2010 Sora ..... E02F 9/2091 60/459
2012/0185141 A1 7/2012 Kamado et al.
(Continued)

FOREIGN PATENT DOCUMENTS

EP 2982849 B1 8/2018
JP H04131433 A 5/1992
(Continued)

OTHER PUBLICATIONS

International Search Report related to Application No. PCT/EP2022/025383; reported on Feb. 13, 2023.
(Continued)

*Primary Examiner* — Mahmoud S Ismail

(57) ABSTRACT

PROBLEM: To enable accurately controlling and managing by means of software, a relief pressure of a pump oil passage supplied with a discharge oil of a hydraulic pump. SOLUTION: There are provided a target engine torque setting/calibration unit (19) during relief configured to detect an engine torque in a state where a pump flow rate is regulated so that a detected pressure value of a pump oil passage (2) during the relief reaches a target relief pressure (LPt), and to set and calibrate the detected engine torque as a target engine torque (LTt) during relief, and a control unit (20) during relief configured to control a pump flow rate so that the detected value of the engine torque reaches the target engine torque (LTt) during the relief.

6 Claims, 7 Drawing Sheets

(58) Field of Classification Search
USPC ..... 701/50
See application file for complete search history.

(56) References Cited

U.S. PATENT DOCUMENTS

| | | | | |
|---|---|---|---|---|
| 2014/0230785 | A1* | 8/2014 | Kawaguchi | B60P 1/162 123/349 |
| 2017/0121944 | A1* | 5/2017 | Kajita | E02F 9/2242 |
| 2018/0016770 | A1* | 1/2018 | Honda | F15B 21/14 |
| 2022/0307595 | A1* | 9/2022 | Amboji | F16H 47/02 |

FOREIGN PATENT DOCUMENTS

| | | | |
|---|---|---|---|
| JP | H1194105 | A | 4/1999 |
| JP | H11303150 | A | 11/1999 |
| JP | 2010101446 | A | 5/2010 |
| JP | 2012141705 | A | 7/2012 |
| JP | 2021042602 | A | 3/2021 |

OTHER PUBLICATIONS

Japan Patent and Trademark Office action and Search Report for JP Patent Application No. 2024-508758, mailed Mar. 6, 2025 (04 pgs).

* cited by examiner

HYDRAULIC CONTROL SYSTEM AND SETTING METHOD AND CALIBRATION METHOD OF TARGET ENGINE TORQUE DURING RELIEF IN HYDRAULIC CONTROL SYSTEM

CROSS-REFERENCE TO RELATED APPLICATION

This Application is a 35 USC § 371 US National Stage filing of International Application No. PCT/EP2022/025383 file Aug. 19, 2022 which claims priority under the Paris Convention to Japanese Patent Application No. 2021-137855 filled on Aug. 26, 2021.

FIELD OF THE INVENTION

The present invention relates to a technical field of a hydraulic control system in a work machine such as a hydraulic shovel.

BACKGROUND OF THE INVENTION

Generally, a work machine such as a hydraulic shovel is provided with a hydraulic pump driven by an engine as a hydraulic supply source of a plurality of hydraulic actuators, but the circuit pressure of the pump oil passage to which the discharge oil of the hydraulic pump is supplied (maximum pressure) is generally configured to be limited by a relief valve located in the relief oil passage from the pump oil passage to the oil tank. However, in the relief valve, when the flow rate passing through the relief valve increases, the upstream pressure (circuit pressure) of the relief valve also rises due to the override characteristic. Therefore, in order to control the circuit pressure accurately, the flow rate during the relief increases. It is necessary to adjust the set pressure of the relief valve according to the above. However, the flow rate during the relief in a work machine such as a hydraulic shovel has a large individual difference due to the variation in engine output, the variation in pump efficiency, etc. Therefore, at the time of shipping the relief valve or the valve unit in which the relief valve is incorporated, even if the set pressure of the relief valve is regulated so that the circuit pressure during relief is the target relief pressure, there is a problem that it is necessary to readjust the relief valve while it is mounted on the work machine, which is troublesome.

Therefore, an electric variable relief valve is used as a relief valve for pressure control of a specific hydraulic actuator circuit, and the override pressure characteristic is corrected based on the input signal regarding the set pressure of the electric variable relief valve and the flow rate passing through the relief valve. However, there is known a technique provided with a control means for outputting the corrected signal to an electric variable relief valve (see, for example, Patent Document 1).

PRIOR ART DOCUMENT

Patent Document

PATENT DOCUMENT 1: Japanese Unexamined Patent Publication No. 2012-141705

SUMMARY OF THE INVENTION

Problems to be Solved by the Invention

However, in Patent Document 1, the value of the flow rate passing through the relief valve is required in order to correct the override pressure characteristic, and the hydraulic actuator set flow rate (attachment set flow rate) set individually according to the hydraulic actuator is used as the value of the flow rate passing through the relief valve. Therefore, the one of Patent Document 1 can be adopted when it is desired to control the circuit pressure of a specific hydraulic actuator circuit in which the supply flow rate is preset. However, there is a problem that it cannot be used for circuit pressure control of pump oil passages such as hydraulic shovels where there are individual differences in flow rate, during relief due to variations in engine output and pump efficiency. Further, circuit pressure (maximum pressure) control is important from the viewpoint of protection of various hydraulic equipment constituting the circuit and failure prediction, and there is a demand for long-term control and management. This is the problem to be solved by the present invention.

Means for Solving the Problems

The present invention has been created with an object to solve these problems in view of actual circumstances as described above. An invention described in claim 1 is a hydraulic control system for a work machine configured to comprise a hydraulic pump of variable displacement type driven by an engine, and used as a hydraulic supply source for a plurality of hydraulic actuators; a relief valve disposed in a relief oil passage routed from a pump oil passage which is supplied with discharge oil of the hydraulic pump to an oil tank; and a pump control means for outputting a control command to a displacement varying means of the hydraulic pump to control a pump flow rate, the hydraulic control system being provided with a relief pressure control means for controlling a pressure in the pump oil passage during a relief when the relief valve opens, as well as the relief pressure control means comprising:

- a pump pressure detection means for detecting the pressure in the pump oil passage;
- an engine torque detection means for detecting an engine torque;
- a target engine torque setting means during relief for setting an engine torque detected in a state where the pump flow rate is regulated so that a detected pressure value of the pump oil passage during the relief reaches a preset target relief pressure, as a target engine torque during relief; and
- a control means during relief for outputting a control command to the pump control means so that the detected value of the engine torque during the relief becomes the target engine torque during relief to control the flow rate of the hydraulic pump.

An invention described in claim 2 is a setting method for a target engine torque during relief in a hydraulic control system, wherein the method is a method for setting a target engine torque during relief using the target engine torque setting means during relief described in claim 1, the setting method comprising the steps of:

- regulating a pump flow rate so that a pressure detection value of a pump oil passage reaches a preset target relief pressure during a relief;
- detecting an engine torque when the pressure detection value of the pump oil passage reaches the target relief pressure, and determining whether the detected engine torque falls within the range of a preset initial setting target engine torque; and
- if the detected engine torque falls within the range of the initial setting target engine torque, setting the initial setting target engine torque as a target engine torque during relief, and if the detected engine torque falls beyond the range of the initial setting target engine torque, setting the detected engine torque as the target engine torque during relief.

An invention described in claim 3 is the hydraulic control system according to claim 1, wherein a calibration means for calibrating a value of the target engine torque during relief, which is set by the target engine torque setting means during relief, is provided in the hydraulic control system.

An invention described in claim 4 is a calibration method for a target engine torque during relief in a hydraulic control system, wherein the method is a method for calibrating a value of a target engine torque during relief using the calibration means described in claim 3, the calibration method comprising the steps of:

regulating a pump flow rate so that a pressure detection value of a pump oil passage reaches a preset target relief pressure during a relief;

detecting an engine torque when the pressure detection value of the pump oil passage reaches the target relief pressure, and determining whether the detected engine torque falls within the range of a predetermined target engine torque during relief; and if the detected engine torque falls within the range of the predetermined target engine torque during relief, setting the predetermined target engine torque during relief as it is, i.e., the target engine torque during relief, and if the detected engine torque falls beyond the range of the predetermined target engine torque during relief, setting the detected engine torque as a new target engine torque during relief that has been calibrated.

An invention described in claim 5 is a hydraulic control system for a work machine configured to comprise a hydraulic pump of variable displacement type driven by an engine, and used as a hydraulic supply source for a plurality of hydraulic actuators; a relief valve disposed in a relief oil passage routed from a pump oil passage which is supplied with discharge oil of the hydraulic pump to an oil tank; and a pump control means for outputting a control command to a displacement varying means of the hydraulic pump to control a pump flow rate, the hydraulic control system being provided with a relief pressure control means for controlling a pressure in the pump oil passage during a relief when the relief valve opens, as well as the relief pressure control means comprising:

a pump pressure detection means for detecting the pressure in the pump oil passage;

a target engine torque setting means during relief for calculating an engine torque, in a state where the pump flow rate is regulated so that a detected pressure value of the pump oil passage during the relief reaches a preset target relief pressure, based on the pump flow rate and the detected pressure value, and setting the calculated engine torque as a target engine torque during relief; and a control means during relief for outputting a control command to the pump control means so that the engine torque during the relief becomes the target engine torque during relief to control the flow rate of the hydraulic pump.

An invention described in claim 6 is a setting method for a target engine torque during relief in a hydraulic control system, wherein the method is a method for setting a target engine torque during relief using the target engine torque setting means during relief described in claim 5, the setting method comprising the steps of:

regulating a pump flow rate so that a pressure detection value of a pump oil passage reaches a preset target relief pressure during a relief;

calculating an engine torque based on the regulated pump flow rate and the pressure detection value, and determining whether the calculated engine torque falls within the range of a preset initial setting target engine torque; and if the calculated engine torque falls within the range of the initial setting target engine torque, setting the initial setting target engine torque as a target engine torque during relief, and if the calculated engine torque falls beyond the range of the initial setting target engine torque, setting the calculated engine torque as the target engine torque during relief.

An invention described herein is a hydraulic control system, wherein a calibration means for calibrating a value of the target engine torque during relief, which is set by the target engine torque setting means during relief, is provided in the hydraulic control system.

An invention described herein is a calibration method for a target engine torque during relief in a hydraulic control system, wherein the method is a method for calibrating a value of a target engine torque during relief using the calibration means described herein, the calibration method comprising the steps of:

regulating a pump flow rate so that a pressure detection value of a pump oil passage reaches a preset target relief pressure during a relief;

calculating an engine torque based on the regulated pump flow rate and the pressure detection value, and determining whether the calculated engine torque falls within the range of a predetermined target engine torque during relief; and if the calculated engine torque falls within the range of the predetermined target engine torque during relief, setting the predetermined target engine torque during relief as it is, i.e., the target engine torque during relief, and if the calculated engine torque falls beyond the range of the predetermined target engine torque during relief, setting the calculated engine torque as a new target engine torque during relief that has been calibrated.

An invention described herein is a hydraulic control system, wherein a monitoring means for monitoring calibration information by the calibration means is provided therein.

FAVORABLE EFFECTS OF THE INVENTION

According to the inventions described in claims 1 and 5, even if there are individual differences such as variation in engine outputs and pump efficiencies of individual work machines, it will become possible to control and manage relief pressures with high accuracy, thereby enabling suppression of load variation during a relief and great contribution to the protection and life extension of various hydraulic equipment that constitutes the hydraulic system.

According to the inventions described in claims 2 and 6, setting of the target engine torque during relief necessary for controlling the relief pressure to reach the target relief pressure can be performed accurately and simply.

According to the inventions described herein, control and management of the relief pressure can be performed accurately for a prolonged period.

According to the inventions described herein, calibration of the target engine torque during relief can be performed accurately and simply.

According to the invention described herein, calibration information can be effectively used for failure predictions or the like of hydraulic equipment.

DETAILED DESCRIPTION OF THE INVENTION

Figure 1:
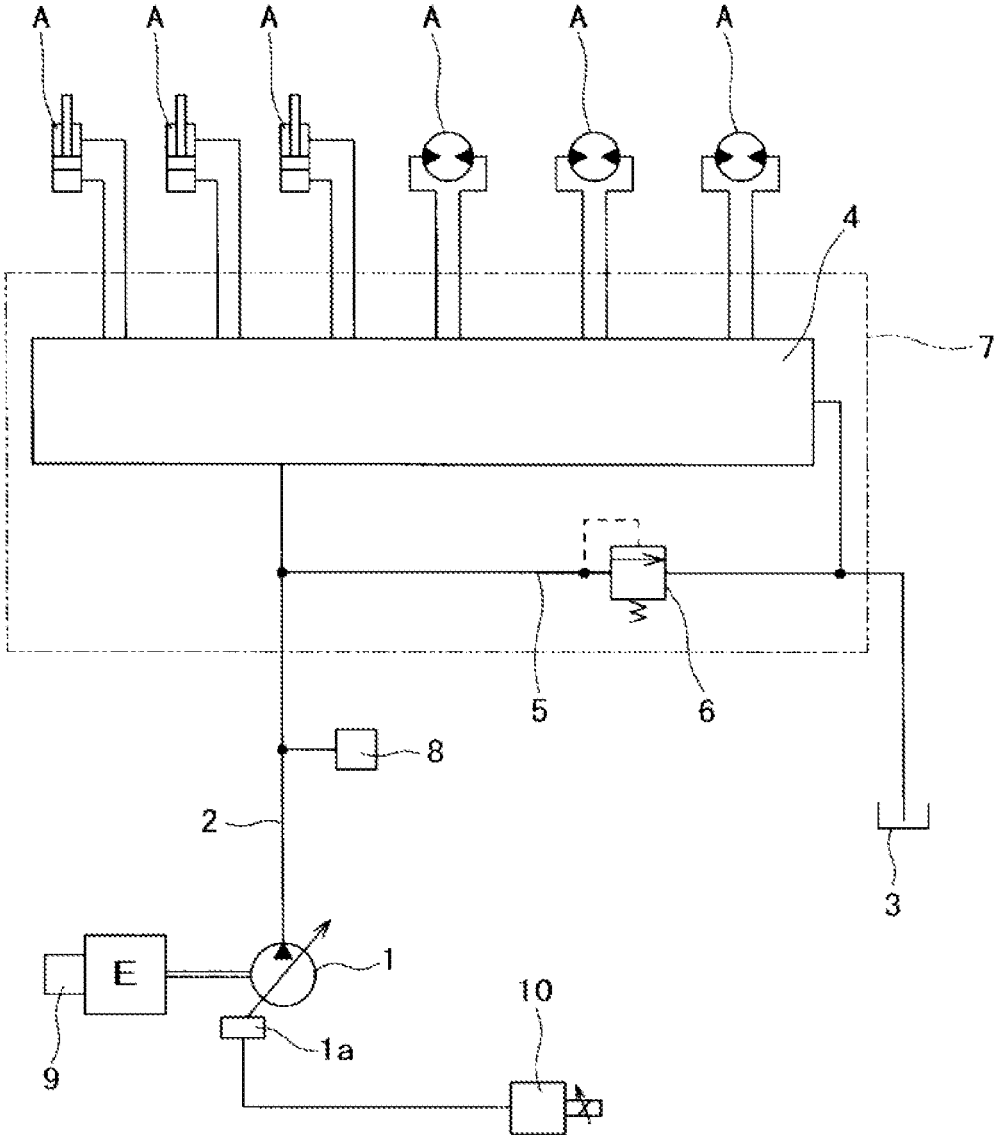
FIG. 1 is a schematic hydraulic circuit diagram of a work machine.

Hereinbelow, embodiments of the present invention will be described with reference to the drawings. FIG. 1 is a schematic view of a hydraulic circuit of a work machine such as a hydraulic shovel. In FIG. 1, reference numeral 1 denotes a variable displacement type hydraulic pump driven by the power of an engine E mounted on the work machine; 1*a* denotes a regulator that makes the displacement of the hydraulic pump 1 variable; 2 denotes a pump oil passage to which a discharge oil of the hydraulic pump 1 is supplied; 3 denotes an oil tank; "A" denotes hydraulic cylinders that drive the hydraulic pump 1 as hydraulic supply sources and various hydraulic actuators such as hydraulic motors (for example, when the work machine is a hydraulic shovel, left and right traveling motors, revolving motor, boom cylinder, stick cylinder, bucket cylinder, etc.); that drives; 4 denotes a spool group in which spools (not shown) for hydraulic actuators are disposed collectively, which perform oil supply and discharge control with respect to each of the hydraulic actuators A; 5 denotes a relief oil passage that is branched from the pump oil passage 2 and route to the oil tank 3; 6 denotes a relief valve disposed in the relief oil passage 5; 7 denote a control valve unit in which the above-described spool group 4 and the relief valve 6 and other components are incorporated. Furthermore, 8 denotes a pump pressure sensor (corresponding to a pump pressure detection means of the present invention) that detects a pressure of the pump oil passage 2 (a discharge pressure of the hydraulic pump 1); 9 denotes an engine torque detection means for detecting an engine torque; and 10 denotes an electromagnetic proportional valve for pump displacement control that outputs a control pressure for varying displacement to the regulator 1*a* of the hydraulic pump 1 based on a control signal from the pump control unit 17 described below. In the present embodiment, the engine torque detection means 9 is used to detect and calculate the engine torque based on a fuel injection amount and is provided in an engine controller. Further, the regulator 1*a* and the electromagnetic proportional valve 10 for pump displacement control corresponds to a displacement varying means of the present invention.

Figure 2:
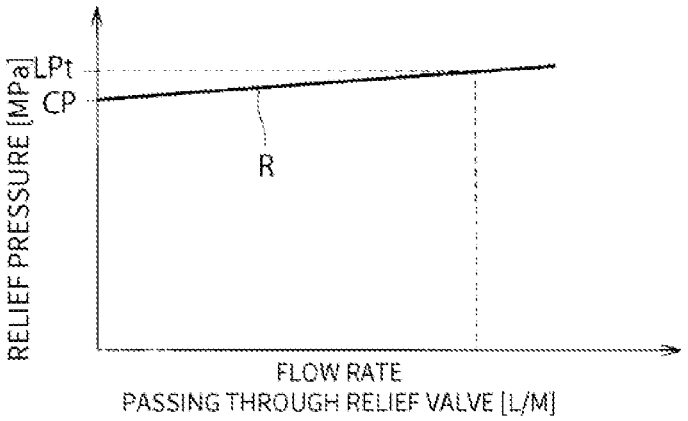
FIG. 2 is a diagram showing an override characteristic of a relief valve.

The relief valve 6 is designed to limit a maximum pressure of the pump oil passage 2, and a balance piston type is used in the present embodiment, but the relief valve 6 is an when the flow rate passing through the relief valve 6 increases, as shown in an override characteristic line R of FIG. 2, the relief pressure (upstream pressure of the relief valve 6, that is, the pressure of the pump oil passage 2) is designed to gradually increase from a cracking pressure CP by means of the override characteristics. Therefore, the pump flow rate when the pressure of the pump oil passage 2 (pump pressure) reaches a preset target relief pressure LPt, in a state where a total amount of the pump flow rate is relieved by the relief valve 6 is designed to be uniquely determined in accordance with the override characteristics. The cracking pressure CP of the relief valve 6 is preliminarily regulated so as to be lower than the target relief pressure LPt by a predetermined pressure.

Figure 3:
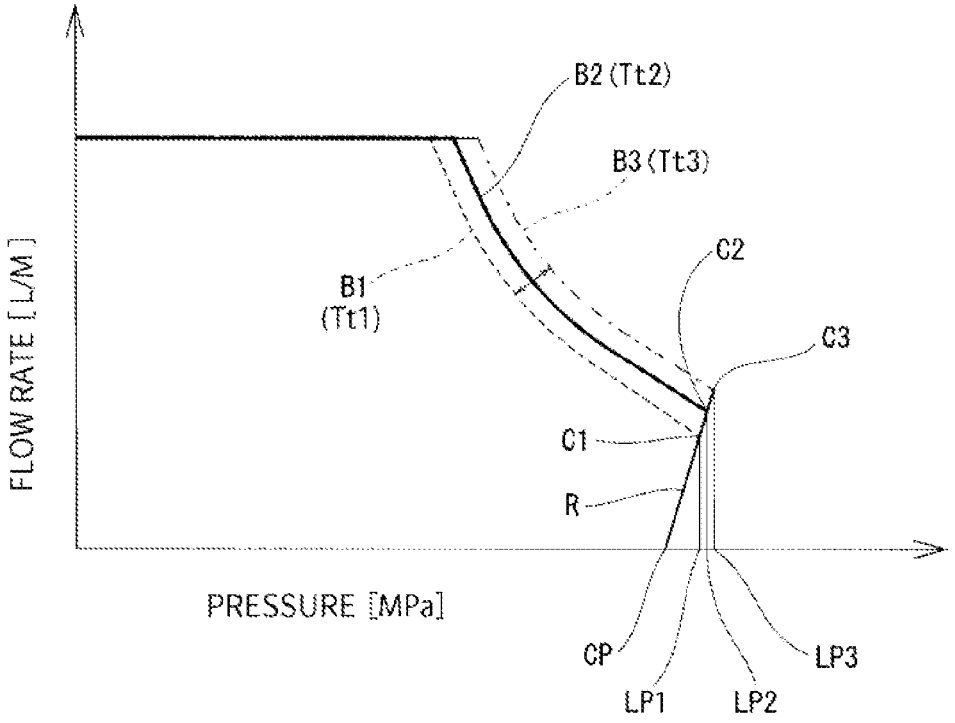
FIG. 3 is a diagram showing an output characteristic of a hydraulic pump.

Further, FIG. 3 is a diagram showing the output characteristics of the hydraulic pump 1, and in the region where the pump pressure is at middle-high pressure, as shown by the pressure/flow rate characteristic curves B (B1, B2, B3), the pump flow rate is controlled in accordance with the pump pressure so as to keep an output torque (or horsepower) of the hydraulic pump 1 at a constant level, and further the above pressure/flow rate characteristic curves B are controlled so as to shift in an arrow direction depending on an increase/decrease of a preset target engine torque Tt. FIG. 3 shows the pressure/flow rate characteristic curves B1, B2, and B3 when the target engine torques are at Tt1, Tt2, and Tt3. Further, in FIG. 3, "R" denotes an override characteristic line showing the override characteristic of the relief valve 6, and intersection points C1, C2, and C3 between the override characteristic line R and the pressure/flow rate characteristic curves B1, B2, and B3 become relief points of the relief valve 6 when the target engine torques are at Tt1, Tt2, Tt3, and the pump pressure at the relief points C1, C2, C3 become relief pressures LP1, LP2, LP3. That is, the relief pressure LP vary depending on the value of the target engine torque Tt. For example, in FIG. 3, the relief pressure when the target engine torque is at Tt2 (when the pressure/flow rate characteristic curve is B2) becomes LP2.

Figure 4:
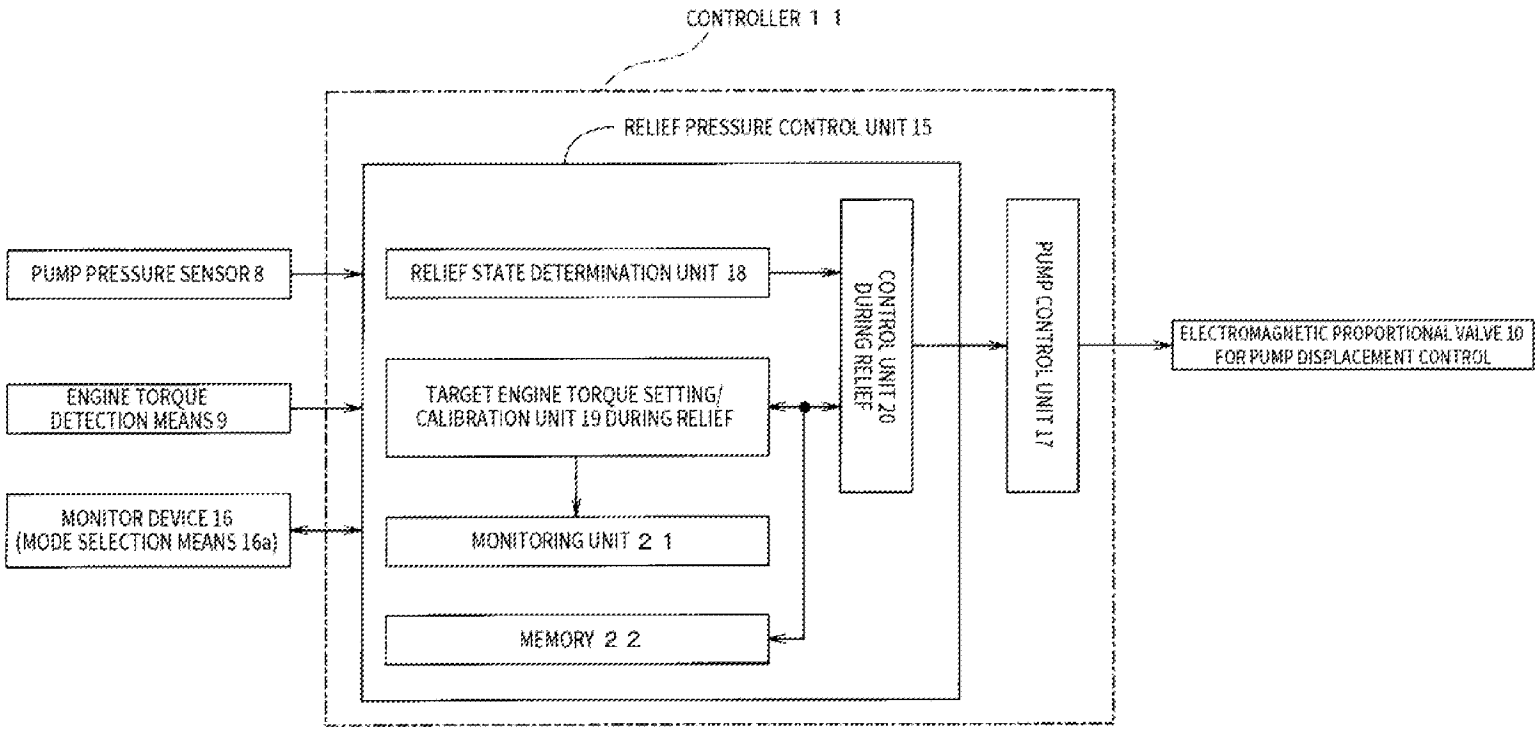
FIG. 4 is a block diagram showing a configuration of a relief pressure control unit.

On the other hand, a controller 11 for controlling various operations of the machine body according to an operator's operation, engine output, etc. is mounted on the work machine, and the controller 11 is provided with a relief pressure control unit 15 for controlling a relief pressure (a maximum pressure in circuit) of the pump oil passage 2. The relief pressure control unit 15, as shown in the block diagram of FIG. 4, is connected to a pump pressure sensor 8 for detecting the pressure of the pump oil passage 2; an engine torque detection means 9 for detecting engine torque; a monitoring device 16 provided in an cab and the like of the work machine and configured to function as a device that performs input operations and display outputs to the controller 11; a pump control unit 17 that outputs a control signal to the electromagnetic proportional valve 10 for the pump displacement control, and the like. Besides, the relief pressure control unit 15 includes a relief state determination unit 18 described below; a target engine torque setting/calibration unit 19 during relief; a control unit 20 during relief; a monitoring unit 21, a memory 22, and the like. The controller 11 is provided with various control units such as hydraulic actuator control units that control the supply flow rate and the pump flow rate to various hydraulic actuators based on the operation of the operating tool and the like, in addition to the relief pressure control unit 15. However, FIG. 4 shows only the portion related to the relief pressure control unit 15. Further, the relief pressure control unit 15, the pump pressure sensor (pump pressure detection means) 8, and the engine torque detection means 9 constitute the relief pressure control means of the present invention. Furthermore, the pump control unit 17 corresponds to the pump control means of the present invention; the target engine torque setting/calibration unit 19 during relief corresponds to the target engine torque setting means and the calibration means during relief of the present invention; the control unit 20 during relief corresponds to the control means during relief of the present invention; and the monitoring unit 21 corresponds to the monitoring means of the present invention.

Next, each part of the relief state determination unit 18, the target engine torque setting/calibration unit 19 during relief, the control unit 20 during relief, and the monitoring unit 21 provided in the relief pressure control unit 15 will be described.

The relief state determination unit 18 is configured to determine whether the pump oil passage 2 is in the relief state, and to output a determination result to the relief control unit 20 during relief. In the present embodiment, the determination whether the pump oil passage 2 is in the relief state is configured such that, if a state where the pressure of the pump oil passage 2 detected by the pump pressure sensor 8 is a neighboring value of the preset target relief pressure LPt (for example, a target relief of ±2 Mpa) continues for a certain period of time or longer, then it is determined to be in the relief state.

The target relief pressure LPt is preset as a target value of the relief pressure (maximum pressure in circuit) of the pump oil passage 2 and is previously stored in the memory 22. However, it may be configured such that the target relief pressure is set arbitrarily using the monitoring device 16.

Further, outputting from the relief state determination unit 18 to the control unit 20 during relief is not performed in a case where the setting and calibration of the target engine torque LTt during relief is executed (in a case of "setting, calibration mode" described later) in the target engine torque setting/calibration unit 19 during relief described below.

Furthermore, the determination of whether the pump oil passage 2 is in the relief state by the relief state determination unit 18 is not limited to the determination based on the pressure detection value of the pump oil passage 2 as described above. It can be also configured to provide, for example, a cylinder end detection means for detecting a state in which a hydraulic cylinder provided in the work is positioned at a cylinder end, and an operation detection means for detecting a state in which an operating tool for the hydraulic cylinder is being operated, and if a detected state by both of these detection means continues for a certain period of time or longer, then to determine that the pump oil passage 2 is in the relief state.

Further, the target engine torque setting/calibration unit 19 during relief executes the setting and calibration of the target engine torque LTt during relief, which is a target value of the engine torque during relief, based on an operation signal from the monitoring device 16.

Here, the monitoring device 16 is equipped with a mode selection means 16*a* (e.g., operation switch, operation screen or the like) operated by an operator when selecting a "setting, calibration mode" preset as a mode when performing setting, calibration of the target engine torque LTt during relief. Then, the target engine torque setting/calibration unit 19 during relief is configured to start control, when the "setting, calibration mode" is selected based on the operation of the mode selection means 16*a*. Further, in the "setting, calibration mode", a pressurized oil supply to the hydraulic actuator A is not performed, and the total amount of the pump flow rate (discharge flow rate of the hydraulic pump 1) is controlled to pass through the relief valve 6 during the relief. Furthermore, in the "setting, calibration mode", the control in the control unit 20 during relief described below is not executed.

Figure 5:
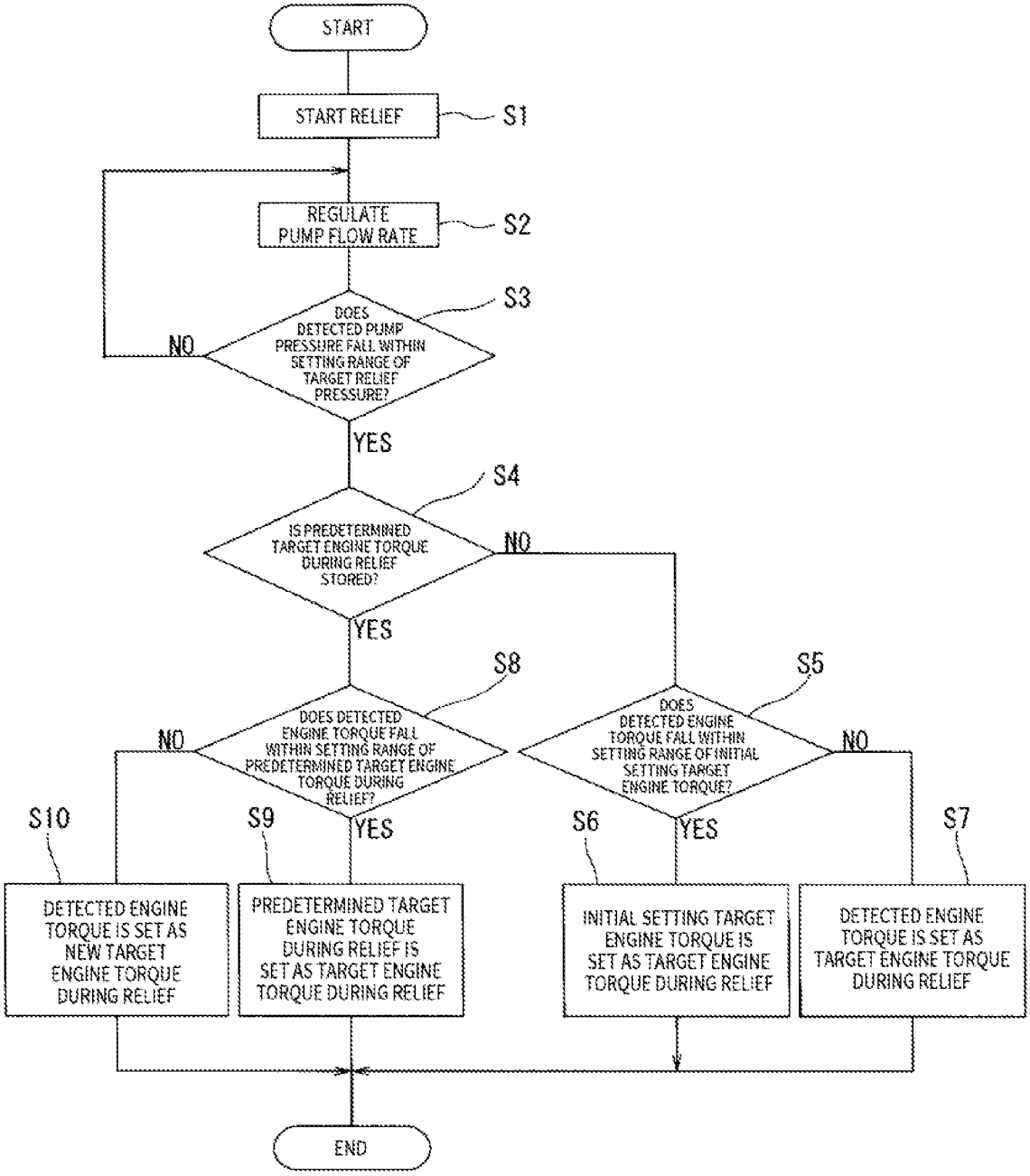
FIG. 5 is a flowchart showing a control procedure of a target engine torque setting/calibration unit during relief.

Next, a control procedure of the setting, calibration of the target engine torque during a relief in the target engine torque setting/calibration unit 19 during relief will be described with reference to the flowchart shown in FIG. 5.

The target engine torque setting/calibration unit 19 during relief, when the control starts, first, outputs a control command to the pump control unit 17 to start the relief of the pump oil passage 2 to increase the pump flow rate (Step S1).

Figure 6:
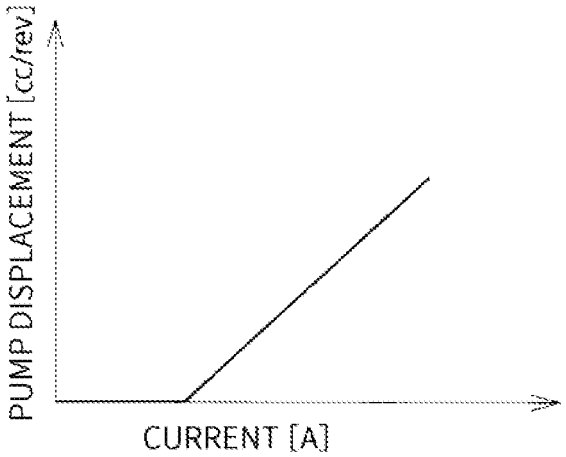
FIG. 6 is a diagram showing a relationship between an output current to an electromagnetic proportional valve for pump displacement control and a pump displacement.

Next, the target engine torque setting/calibration unit 19 during relief reads a pressure (pump pressure) of the pump oil passage 2 detected by the pump pressure sensor 8, and outputs a control command to the pump control unit 17 so that the detected pump pressure becomes within the setting range (for example, the target relief pressure LPt±tolerance) of the preset target relief pressure LPt to regulate the pump flow rate (Step S2). In this case, as shown in FIG. 6, the pump displacement varies as a function of a current value output from the pump control unit 17 to the electromagnetic proportional valve 10 for control of pump displacement, whereby performing regulation of increase or decrease of the pump flow rate. This regulation of the pump flow rate is performed until the detected pump pressure becomes within the setting range of the target relief pressure LPt (Step S3).

Then, if it is determined that the pump pressure falls within the setting range of the target relief pressure LPt, then it is subsequently determined whether the predetermined target engine torque LTt during relief is stored in the memory 22 (Step S4). If the predetermined target engine torque LTt during relief is not stored in the memory 22, then setting of the target engine torque LTt during relief is performed in Steps S5 to S7. If the predetermined target engine torque LTt during relief is stored in the memory 22, then calibration of the target engine torque LTt during relief is performed in Steps S8 to S10.

When setting of the target engine torque LTt during relief is performed (in Step S4, if it is determined that the predetermined target engine torque LTt during relief is not stored in the memory 22), the target engine torque setting/calibration unit 19 during relief subsequently reads a value of the engine torque detected by the engine torque detection means 9, and determines whether the detected engine torque falls within the setting range (for example, initial setting target engine torque±predetermined variation) of an initial setting target engine torque that has been preset as an initial value of the target engine torque during relief (Step S5). If it is determined that the detected engine torque falls within the setting range of the initial setting target engine torque, by the determination in Step S5, the initial setting target engine torque is set as the target engine torque LTt during relief (Step S6). On the other hand, if it is determined that the detected engine torque is not within the setting range of the initial setting target engine torque, the detected engine torque is set as the target engine torque LTt during relief (Step S7). Then, the set target engine torque LTt during relief is stored in the memory 22. Although the initial setting target engine torque is stored in the memory 22 in advance, it may be configured such that an initial setting target engine torque may be arbitrarily set by using the monitoring device 16.

On the other hand, when calibration of the target engine torque LTt during relief is performed (if it is determined in Step S4 that the predetermined target engine torque LTt during relief is stored in the memory 22), the target engine torque setting/calibration unit 19 during relief subsequently reads a value of the engine torque to be detected by the engine torque detection means 9, and determines whether the detected engine torque falls within the setting range (for example, predetermined target engine torque during relief±predetermined variation) of the predetermined target engine torque LTt during relief that has been stored in the memory 22 (Step S8). Then, if it is determined that the detected engine torque falls within the setting range of a predetermined target engine torque LTt, during relief, by the determination in Step S8, then the predetermined target engine torque LTt during relief is set as it is, i.e., the target engine torque LTt during relief (Step S9). On the other hand, if it is determined that the detected engine torque is not within the setting range of the predetermined target engine torque LTt during relief, then the detected engine torque is set as a new target engine torque LTt during relief. Then, the predetermined target engine torque during relief that is stored in the memory 22 is rewritten with the newly set target engine torque LTt during relief.

Then, in the target engine torque setting/calibration unit 19 during relief, the detected engine torque in a state where the pump flow rate is regulated so that the pressure of the pump oil passage 2 during relief becomes the target relief pressure LPt is set or calibrated as the target engine torque LTt during relief and is stored in the memory 22. Then, the target engine torque LTt during relief stored in the memory 22 is output to the relief control unit 20 during relief.

On the other hand, when a determination result that the pump oil passage 2 is in the relief state is input from the relief state determination unit 18, the control unit 20 during relief outputs a control command to the pump control unit 17 so that the detected engine torque detected by the engine torque detection means 9 becomes the latest target engine torque LTt during relief stored in the memory 22 to control the pump flow rate. In other words, the control unit 20 during relief performs a feedback control for increasing the engine torque up to the target engine torque LTt during relief by increasing the pump flow rate, when the detected engine torque is smaller than the target engine torque LTt during relief; on the other hand, for reducing the engine torque down to the target engine torque LTt during relief by reducing the pump flow rate, when the detected engine torque is larger than the target engine torque LTt during relief. In this case, since the target engine torque LTt during relief is a value of the detected engine torque in a state where the pump flow rate is regulated so that the pressure of the pump oil passage 2 during the relief becomes the target relief pressure LPt, by controlling the pump flow rate so that the target engine torque LTt is reached, the pressure in the pump oil passage 2 during relief will be controlled so as to become the target relief pressure LPt.

Furthermore, calibration information (history, data) in the target engine torque setting/calibration unit 19 relief is output to a monitoring unit 21, accumulated and continuously monitored in the monitoring unit 21. The result of the monitoring is output to the monitoring device 16 and displayed as, for example, fluctuation tendency data of engine torques, and can be used for failure prediction and the like.

In the present form configured as described above, a hydraulic control system of a work machine is provided with the variable displacement type hydraulic pump 1 driven by the engine E and used as a hydraulic supply source for the plurality of hydraulic actuators A; the relief valve 6 disposed in the relief oil passage 5 from the pump oil passage 2 supplied with the discharge oil of the hydraulic pump 1 routed to the oil tank 2; and the pump control unit 17 that outputs a control command via the electromagnetic proportional valve 10 for pump displacement to the regulator 1*a* of the hydraulic pump 1 to control the pump flow rate. Besides, the hydraulic control system is further provided with the relief pressure control unit 15 that controls the pressure of the pump oil passage 2 during the relief when the relief valve 6 opens. The relief pressure control unit 15 is connected to the pump pressure sensor 8 for detecting the pressure of the pump oil passage 2, and the engine torque detection means 9 for detecting engine torques, and comprises the target engine torque setting/calibration unit 19 during relief that sets the engine torque detected in a state where the pump flow rate is regulated so that the detected pressure value of the pump oil passage 2 during the relief reaches the preset target relief pressure LPt as the target engine torque LTt during relief, and the control unit 20 during relief that outputs a control command to the pump control unit 17 so that the detected value of the engine torque during relief reaches the target engine torque LTt during relief to control the flow rate of the hydraulic pump 1.

Accordingly, during relief when the relief valve 6 opens, the flow rate of the hydraulic pump 1 will be controlled so that the detected value of the engine torque reaches a target engine torque LTt during relief, but the target engine torque LTt during relief is a value of the engine torque detected in a state where the pump flow rate is regulated so that the detected pressure value of the pump oil passage 2 during relief reaches the target relief pressure LPt. As a result, the pressure in the pump oil passage 2 during relief will be controlled to become the target relief pressure LPt, by controlling the pump flow rate so as to achieve the target engine torque LTt during relief.

As a result, even if there are individual differences such as variation in engine outputs, variation of pump efficiencies of individual work machines, it becomes possible to control and manage with high accuracy the relief pressure so that it becomes the target relief pressure LPt, by controlling the engine torque during relief so that it becomes the target engine torque LTt during relief, thereby enabling suppression of variation of loads during a relief and great contribution to the protection and life extension of various hydraulic equipment that constitutes the hydraulic system. Besides, setting of the target engine torque LTt during relief by the target engine torque setting/calibration unit 19 during relief, and control of the engine torque by the control unit 20 during relief are performed by software with the relief valve 6 being mounted on the work machine. Therefore, it becomes easy to control and manage the relief pressure, and further a regulation work of the relief valve 6 at the time of shipment of single relief valve 6 or the control valve unit 7 incorporating the relief valve 6 therein becomes unnecessary and time and labor for the regulation work can be saved.

In this hydraulic control system, the setting of the target engine torque LTt during relief by the target engine torque setting/calibration unit 19 during relief is performed as the step of regulating the pump flow rate so that the pressure detection value of the pump oil passage 2 during relief reaches the preset target relief pressure LPt (Steps S1, S2, S3 described above); the step of detecting the engine torque when the pressure detection value of the pump oil passage 2 reaches the target relief pressure LPt, and determining whether the detected engine torque falls within the range of an initial setting target engine torque that is preset (Step S5 described above); and the step of, when the detected engine torque falls within the range of initial setting target engine torque, setting the initial setting target engine torque as the target engine torque LTt during relief, and when the detected engine torque is beyond the range of the initial setting target engine torque, setting the detected engine torque as the target engine torque LTt during relief (Steps S6 and S7 described above) are executed in sequence, thereby enabling the setting of the target engine torque LTt during relief required for controlling the relief pressure so that it becomes the target relief pressure LPt to be performed accurately and easily on the software.

Furthermore, since the target engine torque setting/calibration unit 19 during relief is also configured to perform control for calibrating the value of the target engine torque LTt during relief set by the target engine torque setting/calibration unit 19 during relief, control and management of the relief pressure can be accurately performed over a long period of time, by periodically calibrating the value of the target engine torque LTt during relief, for example, before the start of work.

Then, the calibration of the target engine torque LTt during relief by the target engine torque setting/calibration unit 19 during relief is performed as the step of regulating the pump flow rate so that the pressure detection value of the pump oil passage 2 during relief reaches the preset target relief pressure LPt (Steps S1, S2, S3 described above), and the step of detecting the engine torque when the pressure detection value of the pump oil passage 2 reaches the target relief pressure LPt, and determining whether the detected engine torque falls within the range of the predetermined target engine torque LTt during relief (Step S8 described above); the step of, if the detected engine torque falls within the range of an predetermined target engine torque LTt during relief, setting the predetermined target engine torque LTt during relief as it is, i.e., the target engine torque LTt during relief; and the step of, if the detected engine torque falls beyond the range of the predetermined target engine torque LTt, setting the detected engine torque as a new target engine torque LTt during relief that has been calibrated (Steps S9 and S10 described above) are sequentially executed, thereby enabling calibration of the target engine torque LTt during relief required to control the relief pressure so that it becomes the target relief pressure LPt to be accurately and simply performed on the software.

Furthermore, since the calibration information (history, data) of the target engine torque LTt during relief by the target engine torque setting/calibration unit 19 during relief will be accumulated and monitored by the monitoring unit 21, the calibration information can be effectively used for failure predictions of hydraulic equipment.

Of course, the present invention is not limited to the above embodiment, and for example, it is also possible to have a configuration that makes AI (Artificial Intelligence) mounted on the work machine to perform machine learning, and automatically calibrates the value of the target engine torque during relief based on the engine torque during relief under excavation work.

Further, in the above-described embodiment, it is configured to provide an engine torque detection means for detecting an engine torque, and to perform setting, calibration of the target engine torque LTt during relief by using the detected value (detected engine torque) of the engine torque detected by the engine torque detection means. However, without being limited thereto, the present invention can be implemented without use of the detected value of the engine torque detection means. In this case, it is configured so as to provide an engine torque calculating means for calculating the engine torque, in a state where a pump flow rate is regulated so that a detected pressure value of the pump oil passage during relief reaches a preset target relief pressure, based on the pump flow rate and the detected pressure value of the pump oil passage, in the target engine torque setting means during relief and the calibration means, and to perform setting, calibration of the target engine torque LTt during relief by using calculated value of the engine torque (calculated engine torque) calculated by the engine torque calculating means. In this case, the engine torque calculating means, as described above, in a state where a pump flow rate is regulated so that the detected pressure value of the pump oil passage during relief reaches the preset target relief pressure, calculates the engine torque using, for example, the following equation (1), based on the pump flow rate and the detected pressure value of the pump oil passage.

$$Tr = (P \cdot Q)/(2\pi \cdot n \cdot \eta\tau) \quad (1)$$

Figure 7:
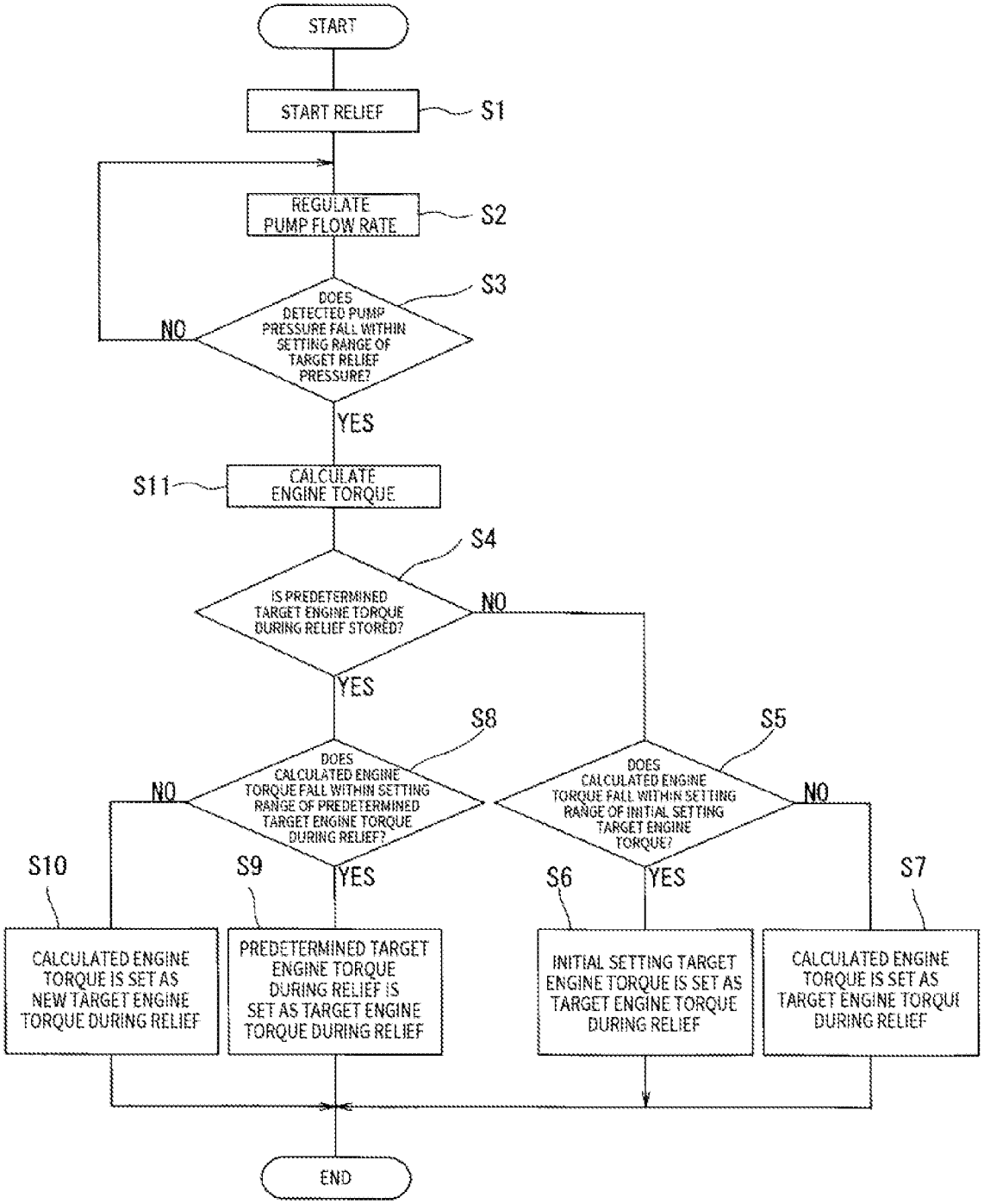
FIG. 7 is a flowchart showing a control procedure for setting and calibration of a target engine torque during relief in another embodiment.

In the above equation (1), Tr is an engine torque, P is a pump pressure, Q is a pump flow rate, n is an engine speed, and $\eta\tau$ is a total efficiency. Then, it becomes possible to set and calibrate a target engine torque during relief, by using a calculated engine torque calculated in this way in place of a detected engine torque of the above-described embodiment. However, in this case, as shown in the flow chart of FIG. 7, after Step S3 of the flowchart of FIG. 5 showing the above-described embodiment, a step (Step S11) of calculating the engine torque based on a value of the regulated pump flow rate and the pressure detection value of the pump oil passage is added, and in Steps S5 to S10, the calculated engine torque is used in place of the detected engine torque. In a case where the calculated engine torque is used in this way, the engine torque detection means may not be provided. However, in this case, the control means during relief (control unit 20 during relief), when a determination result that the pump oil passage 2 is in a relief state is input from the relief state determination unit 18, will determine, based on a pump pressure, a pump flow rate at which the engine torque reaches the target engine torque LTt during relief, and will output a control command to the pump control means (pump control unit 17) so that the pump flow rate is reached.

Further, in the above-described embodiment, it is configured to set and cavitate a target engine torque during relief. However, it can be configured such that the set and calibrated target engine torque during relief are set not only as a target engine torque during the relief but also as a target engine torque in the entire range of the pressure/flow rate characteristic curves B shown in FIG. 3.

INDUSTRIAL APPLICABILITY

The present invention can be utilized for controlling a relief pressure of a pump oil passage supplied with discharge oil of a hydraulic pump in a work machine such as a hydraulic shovel.

The invention claimed is:

1. A hydraulic control system for a work machine configured to comprise a hydraulic pump of variable displacement type driven by an engine to supply oil to a plurality of hydraulic actuators via a pump oil passage; a relief valve disposed in a relief oil passage in communication with the pump oil passage, the relief valve for controlling a pressure in the pump oil passage during a relief when the relief valve opens; the hydraulic control system comprising:

a pump pressure sensor for detecting the pressure in the pump oil passage;

a controller operably connected to the hydraulic pump, the pump pressure sensor, and the engine, the controller configured to:

receive an engine torque of the engine driving the hydraulic pump;

set an engine torque of the engine driving the hydraulic pump as a target engine torque during relief where the pump flow rate is regulated so that a detected pressure value of the pump oil passage during the relief reaches a preset target relief pressure; and output a control command to the hydraulic pump during relief to control the flow rate of the hydraulic pump to the pump oil passage so that the torque of the engine driving the hydraulic pump during the relief becomes the target engine torque during relief.

2. The hydraulic control system according to claim 1, wherein the controller is configured for calibrating a value of the target engine torque during relief.

3. A hydraulic control system for a work machine configured to comprise a hydraulic pump of variable displacement type driven by an engine to supply oil to a plurality of hydraulic actuators via a pump oil passage; a relief valve disposed in a relief oil passage in communication with the pump oil passage, the relief valve for controlling a pressure in the pump oil passage during a relief when the relief valve opens; the hydraulic control system comprising:

a pump pressure sensor for detecting the pressure in the pump oil passage;

a controller operably connected to the hydraulic pump, the pump pressure sensor, and the engine, the controller configured to:

calculate an engine torque in a state where the pump flow rate is regulated so that a detected pressure value of the pump oil passage during the relief reaches a preset target relief pressure, the engine torque being calculated based on the pump flow rate and the detected pressure value;

set the calculated engine torque as a target engine torque of the engine driving the hydraulic pump during relief; and output a control command to the hydraulic pump during relief to control the flow rate of the hydraulic pump to the pump oil passage so that the engine torque of the engine driving the hydraulic pump during the relief becomes the target engine torque during relief.

4. The hydraulic control system according to claim 3, wherein the controller is configured for calibrating a value of the target engine torque during relief.

5. The hydraulic control system according to claim 2, wherein the controller is configured to monitor calibration information.

6. The hydraulic control system according to claim 4, wherein the controller is configured to monitor calibration information.

* * * * *